US008605128B2

(12) United States Patent
Masuda

(10) Patent No.: US 8,605,128 B2
(45) Date of Patent: Dec. 10, 2013

(54) THERMAL PRINTER AND METHOD FOR CONTROLLING THE SAME

(75) Inventor: Ken Masuda, Shizuoka (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 217 days.

(21) Appl. No.: 13/024,463

(22) Filed: Feb. 10, 2011

(65) Prior Publication Data

US 2011/0216149 A1 Sep. 8, 2011

(30) Foreign Application Priority Data

Mar. 8, 2010 (JP) ..... 2010-051004

(51) Int. Cl.
*B41J 2/32* (2006.01)

(52) U.S. Cl.
USPC ..... 347/218

(58) Field of Classification Search
USPC ..... 347/171, 218; 400/82, 188, 120.01
See application file for complete search history.

(56) References Cited

U.S. PATENT DOCUMENTS 8,009,183 B2 * 8/2011 Baba ..... 347/171

FOREIGN PATENT DOCUMENTS

| | | |
|---|---|---|
| JP | 05-309890 | 11/1993 |
| JP | 11-115263 | 4/1999 |
| JP | 2001-071569 | 3/2001 |

OTHER PUBLICATIONS

Machine-generated translation of JP 11-115263, published on Apr. 1999.*

Machine-generated translation of JP 2001-071569, published on Mar. 2001.*

* cited by examiner

*Primary Examiner* — Huan Tran
(74) *Attorney, Agent, or Firm* — Turocy & Watson, LLP

(57) ABSTRACT

A printer includes a thermal head configured to print information on thermal paper, a platen roller configured to press the thermal paper against the thermal head and a paper feed unit configured to convey the thermal paper. The printer further includes a control unit configured to control the paper feed unit to convey a leading edge of the thermal paper to a print waiting position between the thermal head and the platen roller, and also configured to control the paper feed unit to move the leading edge of the thermal paper from the print waiting position to a retracted position upstream the print waiting position.

16 Claims, 12 Drawing Sheets

THERMAL PRINTER AND METHOD FOR CONTROLLING THE SAME

CROSS-REFERENCE TO RELATED APPLICATIONS

This application is based upon and claims the benefit of priority from Japanese Patent Application No. 2010-051004, filed on Mar. 8, 2010, the entire content of which is incorporated herein by reference.

FIELD

Embodiments described herein relate generally to a thermal printer and a method for controlling a thermal printer.

BACKGROUND

A thermal printer has a thermal head arranged along a conveying path of thermal paper having a thermal sensitive layer. The thermal head prints information on the thermal paper.

A platen roller is arranged opposite the thermal head for pressing the thermal paper against the thermal head. After printing, the leading edge of the printed thermal paper is interposed between the thermal head and the platen roller until subsequent printing is initiated.

In this respect, if the initiation of the subsequent printing is delayed for a long time period, the leading edge of the thermal paper may be deformed. Therefore, when the subsequent printing is initiated, the leading edge of the thermal paper may be jammed in the conveying path.

DETAILED DESCRIPTION

According to one embodiment, a printer includes a thermal head configured to print information on thermal paper, a platen roller configured to press the thermal paper against the thermal head, a paper feed unit configured to convey the thermal paper, a control unit configured to control the paper feed unit to convey a leading edge of the thermal paper to a print waiting position between the thermal head and the platen roller, and also configured to control the paper feed unit to move the leading edge of the thermal paper from the print waiting position to a retracted position upstream the print waiting position.

Figure 1:
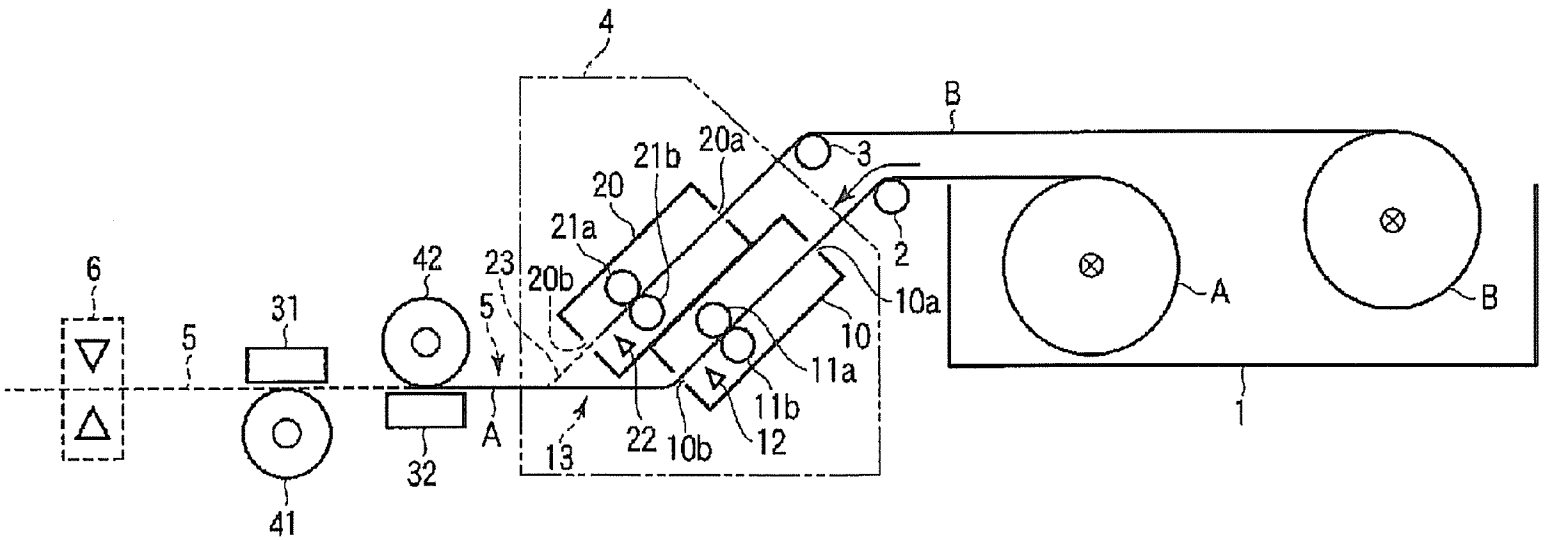
FIG. 1 is a drawing showing a thermal printer with thermal paper positioned to be printed according to one embodiment.

Embodiments of the present disclosure will be described below with reference to the drawings. FIG. 1 illustrates a configuration of a printer according to one embodiment. First thermal paper A and second thermal paper B are accommodated in a paper container unit 1 in the form of a roll. The first thermal paper A is, for example, a double-sided thermal paper having a thermal sensitive layer on one side (front side) and the other side (back side) of the paper. The second thermal paper B is, for example, a single-sided thermal paper having a thermal sensitive layer only on one side (front side) of the paper. The thermal sensitive layer mentioned above may be formed of, for example, a material whose color turns black or red when heated above a predetermined temperature.

Once the double-sided thermal paper A and the single-sided thermal paper B are loaded in the paper container unit 1, the leading edge of the double-sided thermal paper A is discharged while it is being pulled by a roller 2, so as to be inserted into an inlet 10*a* of a first feeder 10 in a paper feed unit 4. First rollers 11*a*, 11*b* rotate forward to move the inserted leading edge of the double-sided thermal paper A into the first feeder 10. If a paper sensor 12 detects the leading edge of the double-sided thermal paper A, the first rollers 11*a* and 11*b* rotate in a reverse direction to position the leading edge of the double-sided thermal paper A back to the beginning of the first rollers 11*a* and 11*b* so that thermal paper A is still between rollers 11*a* and 11*b*.

Likewise, the leading edge of the single-sided thermal paper B is discharged while it is being pulled by a roller 3, so as to be inserted into an inlet 20*a* of a second feeder 20 in the paper feed unit 4. Second rollers 21*a*, 21*b* rotate forward to move the inserted leading edge of the single-sided thermal paper B into the second feeder 20. If a paper sensor 22 detects the leading edge of the single-sided thermal paper B, the second rollers 21*a* and 21*b* rotate in a reverse direction to position the leading edge of the single-sided thermal paper B back to the beginning of the second rollers 21*a* and 21*b* so that the single-sided thermal paper B is between second rollers 21*a* and 21*b*. FIG. 1 illustrates a configuration where the leading edge of the single-sided thermal paper B is positioned at the beginning of the rollers in the manner as described above. The first and second feeders 10 and 20 have outlets 10*b* and 20*b*, respectively. Further, the first and second feeders 10 and 20 include conveying paths 13 and 23, respectively, extending outward from the outlets 10*b* and 20*b*. The conveying paths 13 and 23 are merged into a single conveying path 5. Along the conveying path 5 are arranged a first thermal head 31 for printing information on the front side (one side) of the respective thermal papers A and B, and a second thermal head 32 for printing information on the back side (the other side) of the respective thermal papers A and B. The first and second thermal heads 31 and 32 are provided to extend in a direction perpendicular to the conveying direction of the thermal papers A and B, i.e., in a transverse direction with respect to the thermal papers A and B.

The thermal heads 31 and 32 are arranged apart from each other in the conveying direction of the thermal papers A and B. The first thermal head 31 is positioned downstream in the conveying direction, while the second thermal head 32 is positioned upstream in the conveying direction.

A first platen roller 41 is provided to press either one of the thermal papers A and B against the first thermal head 31. The first platen roller 41 is positioned opposing the first thermal head 31 with the conveying path 5 interposed therebetween. In addition, a second platen roller 42 is provided to press either one of the thermal papers A and B against the second thermal head 32. The second platen roller 42 is positioned opposing the second thermal head 32 with the conveying path 5 interposed therebetween. Furthermore, a cutter 6 is provided to cut either one of the thermal papers A and B. The cutter 6 is positioned downstream from the first thermal head 31 along the conveying path 5.

Figure 2:
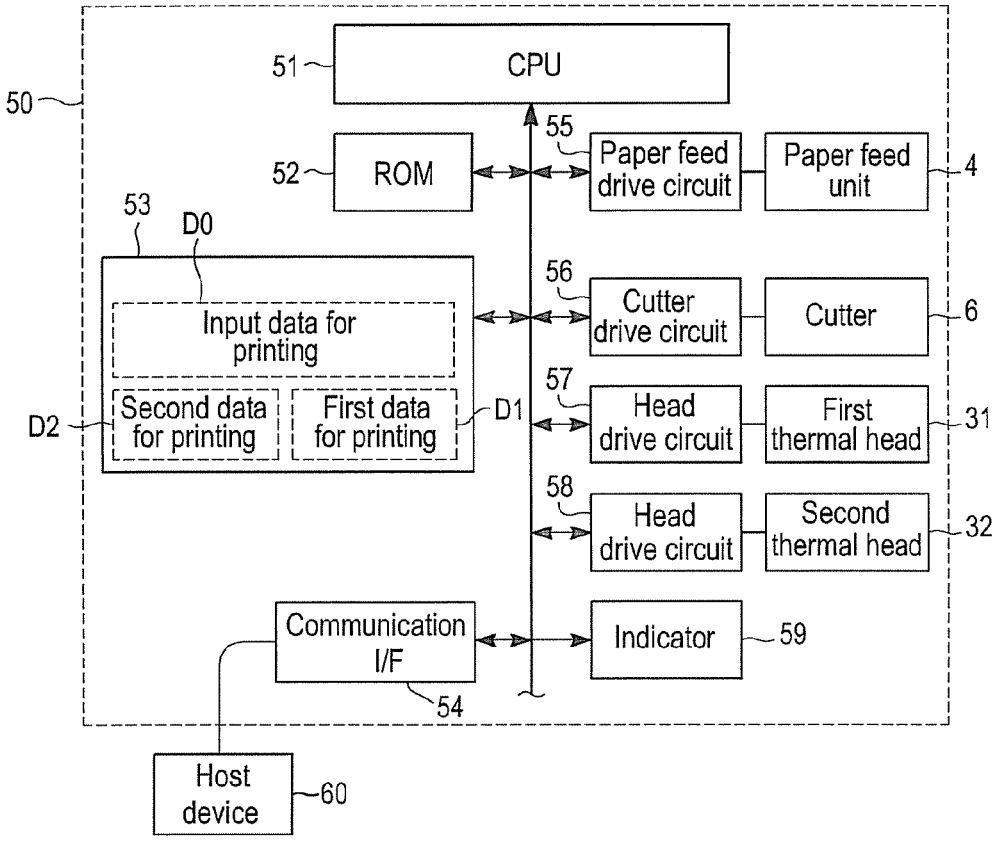
FIG. 2 is a block diagram showing a control unit.

FIG. 2 shows a control unit 50 of a thermal printer 50. In the control unit 50, a CPU 51 is connected to a ROM 52 that stores a control program, a RAM 53 that stores various data, a communication interface 54, a paper feed drive unit 55, a cutter drive unit 56, head drive units 57 and 58, and an indicator 59. In addition, an external host device 60 may be connected to the communication interface 54. The paper feed drive unit 55 drives the paper feed unit 4. This paper feed unit 4 includes the above-described first and second feeders 10 and 20, a motor and any other components. The first and second feeders 10, 20 selectively feed either of the first and second thermal papers A and B to the conveying path 5. The cutter drive unit 56 drives the cutter 6. The head drive units 57 and 58 drive the first and second thermal heads 31 and 32, respectively.

The CPU 51 may include various units for executing its functions. For example, the CPU 51 includes a double-sided print control unit that, when performing double-sided printing, controls the first feeder 10 of the paper feed unit 4 to convey the double-sided thermal paper A from the paper container unit 1 to pass along the conveying path 5. Also, the double-sided print control unit controls the first and second thermal heads 31 and 32 to print information on both sides of the double-sided thermal paper A.

The CPU 51 may include a single-sided print control unit that, when performing single-sided printing, controls the second feeder 20 of the paper feed unit 4 to convey the single-sided thermal paper B in the paper container unit 1 to pass along the conveying path 5. Also, the single-sided print control unit controls the first thermal head 31 to print information on the front side of the single-sided thermal paper B.

The CPU 51 may include a control unit that, after the double-sided printing completes, controls the first feeder 10 of the paper feed unit 4 to move the leading edge of the double-sided thermal paper A to the print waiting position between the second thermal head 32 and the second platen roller 42. Further, after the single-sided printing completes, the control unit controls the second feeder 20 of the paper feed unit 4 to move the leading edge of the single-sided thermal paper B to the print waiting position between the first thermal head 31 and the first platen roller 41.

While no printing is performed for a predetermined time period, the control unit may control at least one of the first and second feeders 10 and 20 of the paper feed unit 4 to move the leading edge of at least one of the first and second thermal papers A and B to a position upstream from their print waiting position where no stress is applied to the paper. For the first thermal paper A, the position where no stress is applied is located at the beginning of the first rollers 11*a* and 11*b* in the first feeder 10. On the other hand, for the second thermal paper B, the position where on stress is applied is located at the beginning of the second rollers 21*a* and 21*b* in the second feeder 20. In some embodiments, a portion of the leading edge of the double-sided thermal paper A may be pressed by the first roller 11*a* and the first roller 11*b*. Further, a portion of the leading edge of the single-sided thermal paper B may be pressed by the second roller 21*a* and the second roller 21*b*. In this manner, less stress is applied to the thermal paper at the above-described positions upstream from the print waiting positions, because a lower pressure is applied at the above-describe positions than the print waiting positions between the thermal heads and the opposing platen rollers.

Figure 3:
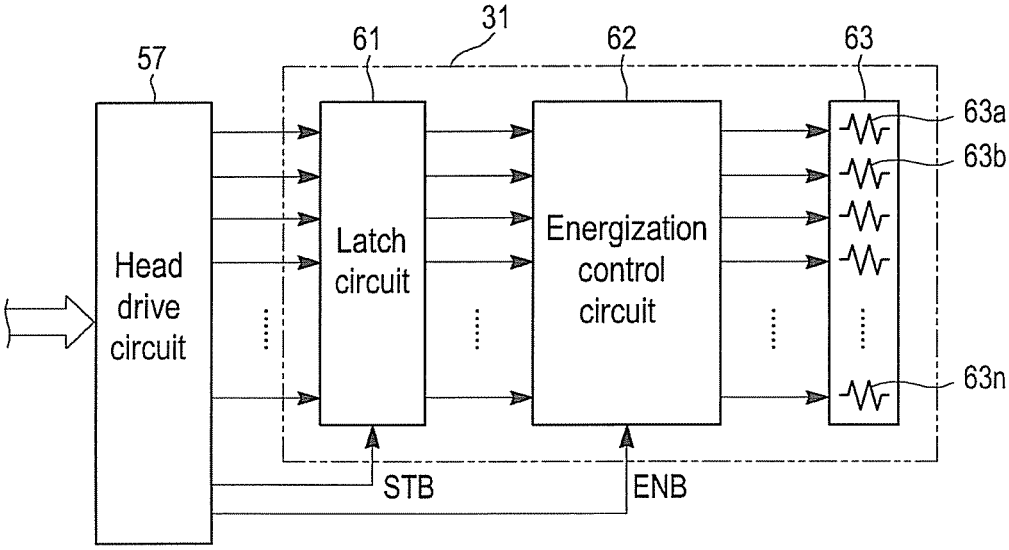
FIG. 3 is a block diagram showing a detailed configuration of a thermal head.

The first thermal head 31 includes, as shown in FIG. 3, a latch unit 61, a power control unit 62, and an edge head 63. The edge head 63 includes a number of heating elements 63*a* to 63*n* arranged linearly for the thermal transfer printing. The latch unit 61 latches line by line a first print data D1 provided from the head drive unit 57 in response to a strobe signal STB provided from the head drive unit 57. The power control unit 62 controls the supply of power to the heating elements 63*a* to 63*n* of the edge head 63 in accordance with the data in the latch unit 61 when an enable signal ENB provided from the head drive unit 57 is activated. Since the second thermal head 32 has the same configuration as the first thermal head 31, a description of the second thermal head 32 is omitted herein for the sake of convenience.

Figure 4:
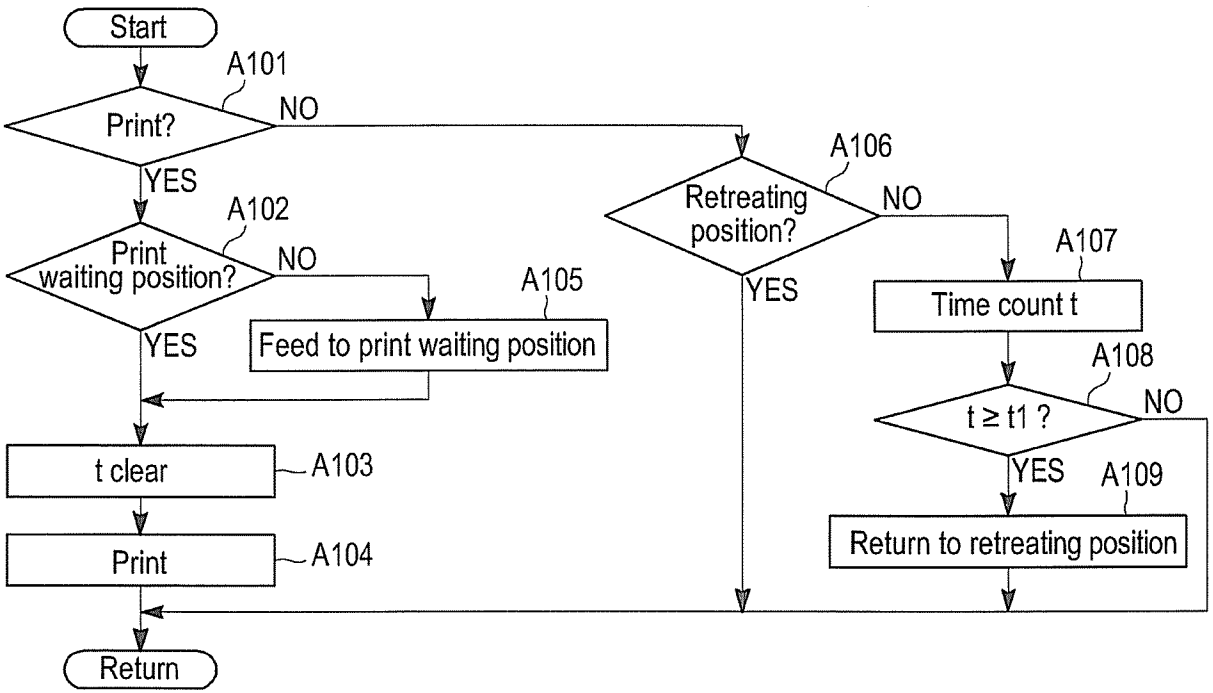
FIG. 4 is a flowchart showing an operation of a thermal printer according to one embodiment.

In the following description, exemplary operations of a thermal printer according to one embodiment are described with reference to the flowchart of FIG. 4. The CPU 51 determines, when initiating double-sided printing (YES of Act A101), whether the leading edge of the double-sided thermal paper A is positioned in the print waiting position, e.g., the position between the second thermal head 32 and the second platen roller 42, as shown in FIG. 1 (Act A102). The position of the leading edge of the double-sided thermal paper A may be detected by monitoring the distance and the conveying direction of the double-sided thermal paper A from the time when the paper sensor 12 of the first feeder 10 first detects the leading edge of the double-sided thermal paper A. Alternatively, a paper sensor for detecting position may be provided at the beginning of the second thermal head 32 and the second platen roller 42.

Figure 5:
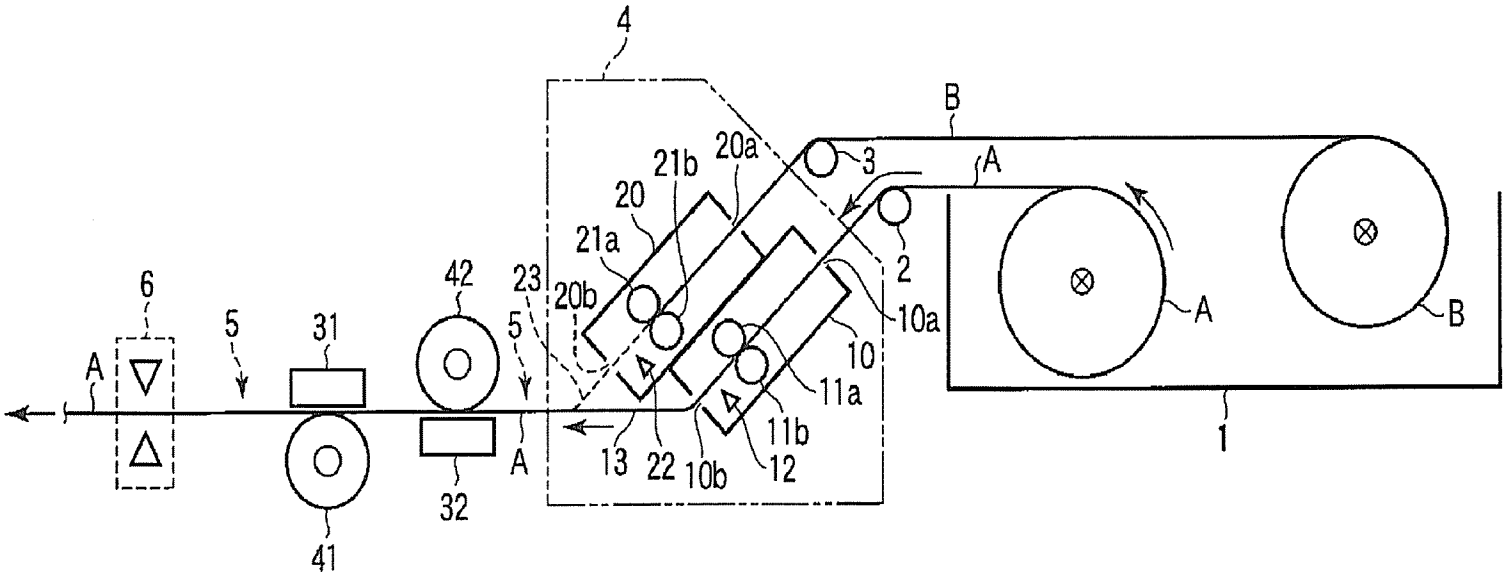
FIG. 5 illustrates thermal paper being conveyed during printing.

If the leading edge of the double-sided thermal paper A is positioned at the print waiting position (YES of Act A102), the CPU 51 initializes a time count t using an internal timer (Act A103). Then, as shown in FIG. 5, the double-sided thermal paper A is conveyed along the conveying path 5 while printing is performed on both sides of thermal paper A (Act A104).

If the leading edge of the double-sided thermal paper A is not positioned at the print waiting position (NO of Act A102), the CPU 51 controls the first feeder 10 to move the leading edge of the double-sided thermal paper A to reach the print waiting position (Act A105). Subsequently, as mentioned above, the CPU 51 initializes the time count t using the internal timer (Act A103), and performs double-sided printing with respect to the double-sided thermal paper A (Act A104).

Figure 6:
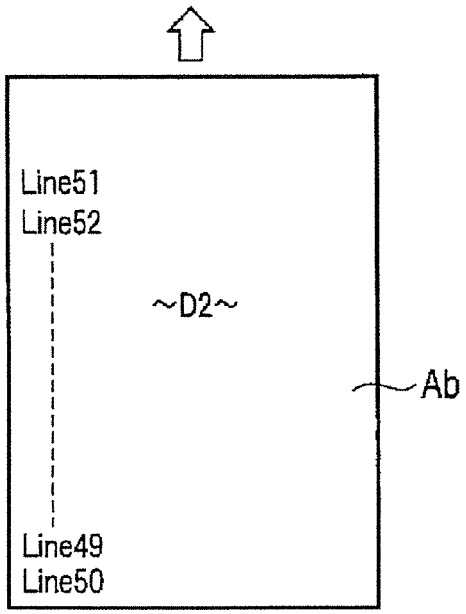
FIG. 6 shows the back side of thermal paper being printed with print data D2.
Figure 7:
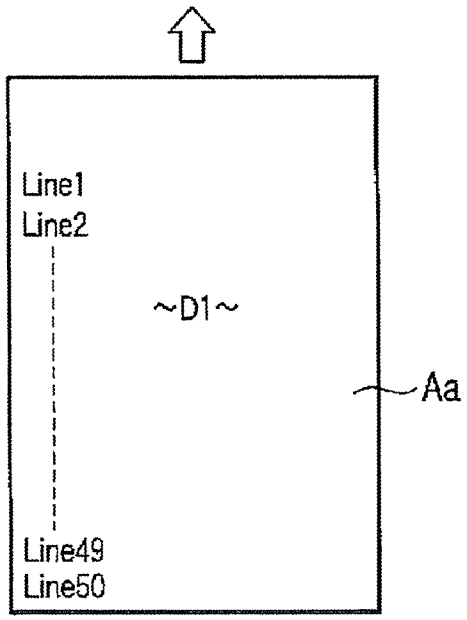
FIG. 7 shows the front side of thermal paper being printed with print data D1.

The CPU 51 stores in the RAM 53 the print data D1 and the print data D2, which is extracted from print data D0 provided from the host device 50. The CPU 51 controls the second thermal head 32 to print the print data D2 on the back side Ab of the double-sided thermal paper A while the double-sided thermal paper A is being conveyed, as shown in FIG. 6. Subsequently, the first thermal head 31 prints the print data D1 on the front side Aa of the double-sided thermal paper A, as shown in FIG. 7.

When the printed area of the double-sided printed thermal paper A passes over the cutter 6, the CPU 51 controls the first feeder 10 to pause the conveying of double-sided thermal paper A. Further, CPU 51 controls the cutter 6 to cut the double-sided thermal paper A. Subsequently, while drawing the double-sided thermal paper A into the first feeder 10, the CPU 51 controls the first feeder 10 to position the leading edge (cut edge) of the double-sided thermal paper A back to the print waiting position, e.g., the position between the second thermal head 32 and the second platen roller 42 as shown in FIG. 1.

In the case of single-sided printing, when initiating single-sided printing (YES of Act A101), if the leading edge of the single-sided thermal paper B is not positioned at the print waiting position between the first thermal head 31 and the first platen roller 41 (NO of Act A102), the CPU 51 controls the second feeder 20 to move the leading edge of the single-sided thermal paper B to reach the print waiting position (Act A105). Subsequently, as mentioned above, the CPU 51 initializes the time count t using the internal timer (Act A103), and performs single-sided printing with respect to the single-sided thermal paper B (Act A104).

Figure 8:
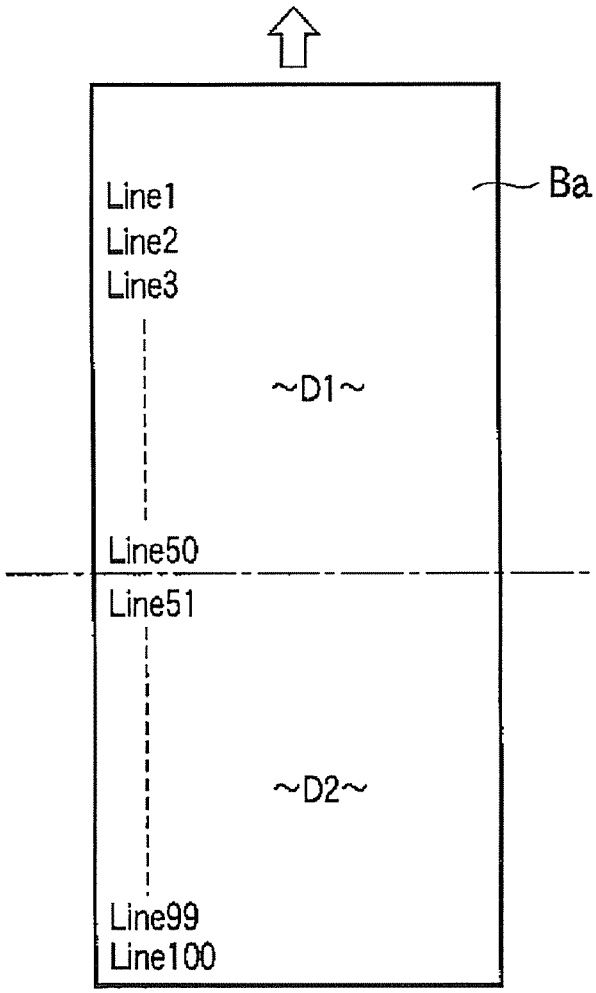
FIG. 8 illustrates the front side of thermal paper being printed with print data D1, D2.

In the case of single-sided printing, the CPU 51 controls the second feeder 20 to feed the single-sided thermal paper B to pass along the conveying path 5, and controls the first thermal head 31 to print the print data D1 on the front side Ba of the single-sided thermal paper B, as shown in FIG. 8. Furthermore, the CPU 51 controls the first thermal head 31 to print the print data D2 on the same front side.

When the printed area of the single-sided printed thermal paper B passes over the cutter 6, the CPU 51 controls the second feeder 20 to pause the conveying of single-sided thermal paper B, and controls the cutter 6 to cut the single-sided thermal paper B. Subsequently, while drawing the single-sided thermal paper B into the second feeder 20, the CPU 51 controls the second feeder 20 to position the leading edge (cut edge) of the single-sided thermal paper B back to the print waiting position, e.g., the position between the first thermal head 31 and the first platen roller 41.

In some embodiments, when initiating double-sided printing (e.g., in Act A101), the CPU 51 may detect that a double-sided thermal paper A does not exist in the first feeder 10 or is displaced (i.e. ripped out or displaced by any other means) by using the paper sensor 12 of the first feeder 10. Upon detection of the above situation, as an alternative measure, the above-explained single-sided printing may be performed using the single-sided thermal paper B in the second feeder 20.

The CPU 51 determines, if no printing is performed (NO of Act A101), whether both the thermal papers A and B are returned to be at the retracted positions (Act A106). The retracted position of the double-sided thermal paper A is located at the beginning of the first rollers 11*a* and 11*b* in the first feeder 10 so that a portion of the leading edge of the double-sided thermal paper A may be pressed by the first roller 11*a* and the first roller 11*b*. The retracted position of the single-sided thermal paper B is located at the beginning of the second rollers 21*a* and 21*b* in the second feeder 20 so that a portion of the leading edge of the single-sided thermal paper B may be pressed by the second roller 21*a* and the second roller 21*b*. Whether the leading edge of the thermal papers A and B are positioned in the retracted positions may be detected by monitoring the distance and the conveying direction of the thermal papers A and B from the time when the paper sensors 12 and 22 in the feeders 10 and 20 first detect the leading edges of the thermal papers A and B, respectively.

Figure 9:
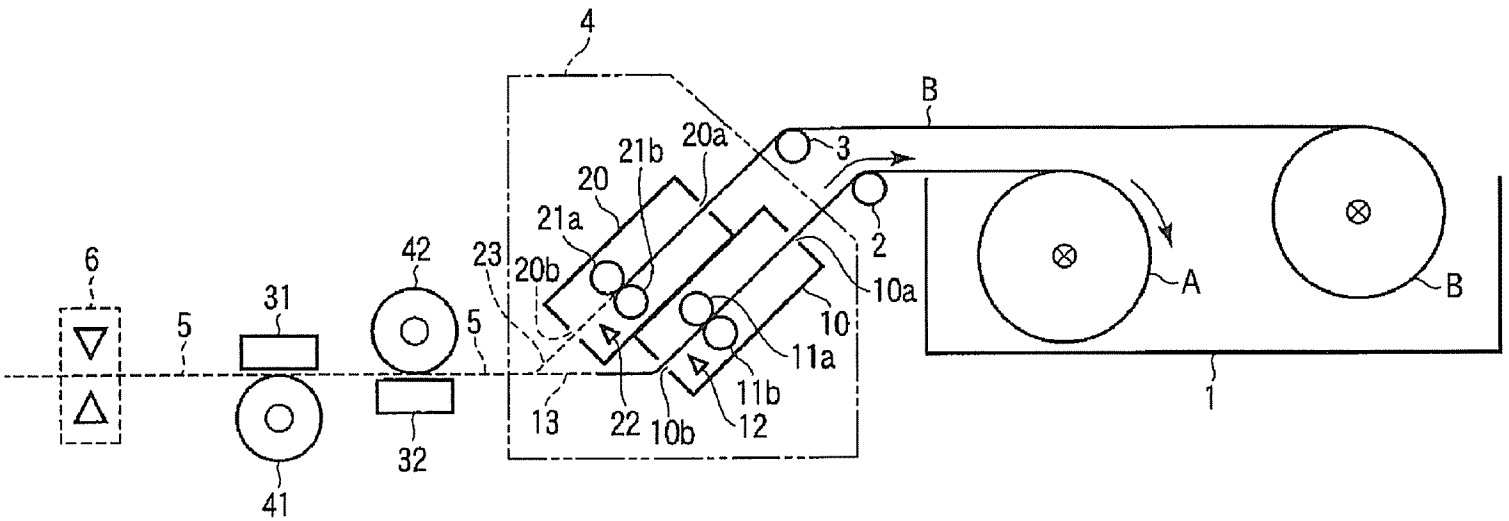
FIG. 9 shows thermal paper being moved.
Figure 10:
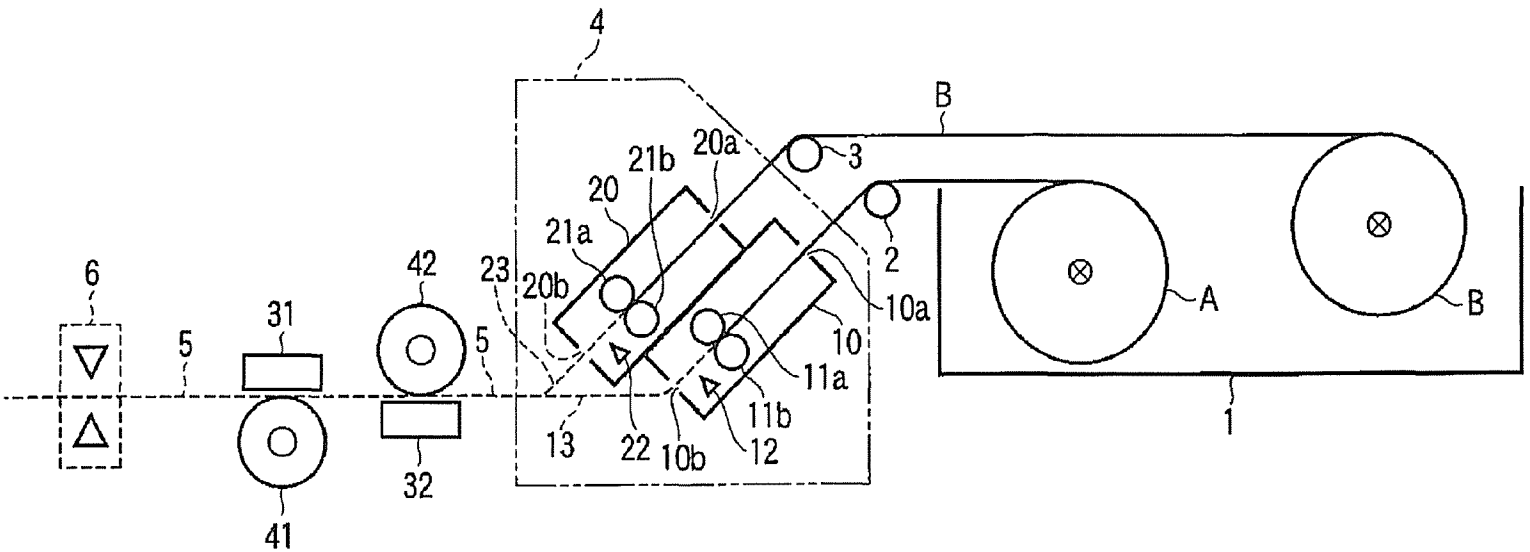
FIG. 10 shows thermal paper in a retracted position.
Figure 11:
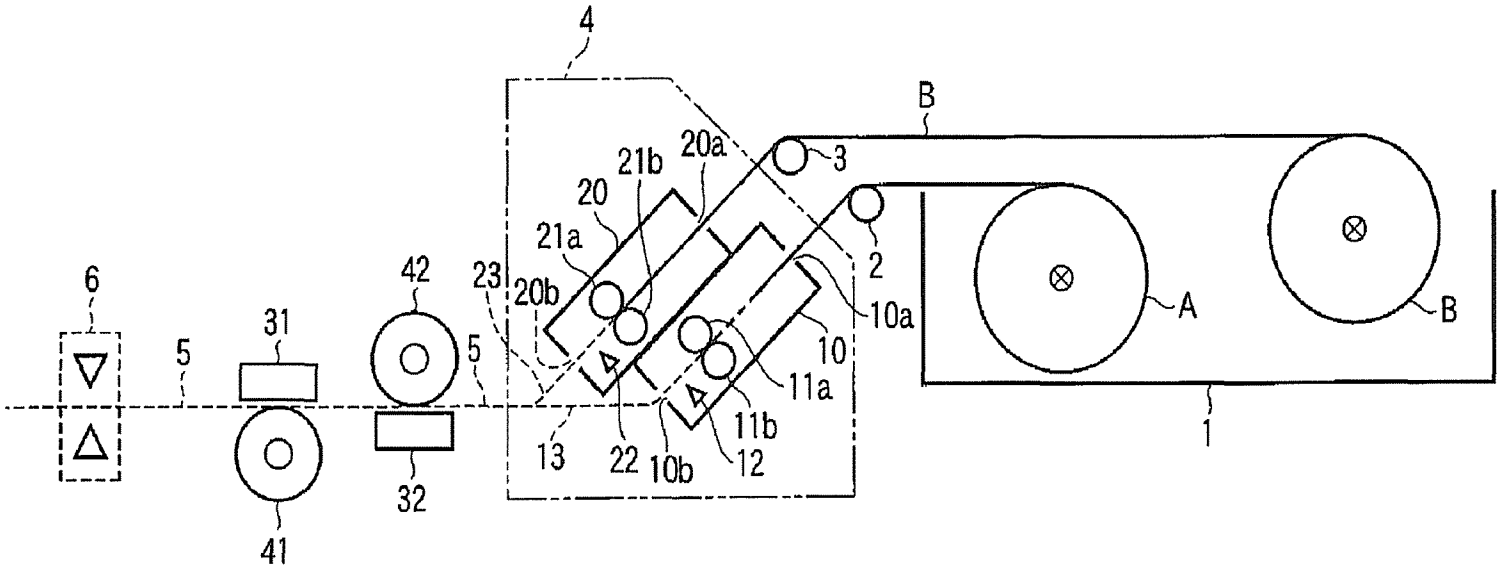
FIG. 11 shows thermal paper in an alternative retracted position.

If no printing is performed (NO of Act A101) and the thermal paper A is located at the print waiting position, e.g., the position between the second thermal head 32 and the second platen roller 42 (NO of Act A106), the CPU 51 initializes the time count t using the internal timer (Act A107), and determines whether the time count t is not less than a predetermined time period t1 (Act A108). In addition, if it is determined that the time count t is not less than the predetermined time t1 (YES of Act A108), the thermal paper A is moved (Act A109). For example, the double-sided thermal paper A is moved, as shown in FIG. 9, so that the leading edge of the double-sided thermal paper A is returned to be positioned at the retracted position in the first feeder 10, as shown in FIG. 10. At the retracted position, a portion of the leading edge of the double-sided thermal paper A may be pressed by the first roller 11*a* and the first roller 11*b*, which reduces stress that may be applied to the leading edge of the double-sided thermal paper A. In some embodiments, the double-sided thermal paper A is drawn, so that the leading edge of the double-sided thermal paper A is fed back to be positioned at the retracted position upstream from the first roller 11*b* in the first feeder 10, as shown in FIG. 11.

Similarly, if no printing is performed (NO of Act A101) and the single-sided thermal paper B is located at the print waiting position (NO of Act A106), the CPU 51 initializes the time count t by the internal timer (Act A107), and determines whether the time count t is not less than a predetermined time t1 (Act A108). In addition, if the time count t is not less than the predetermined time t1 (YES of Act A108), the single-sided thermal paper B is drawn, so that the leading edge of the single-sided thermal paper B is returned to be positioned at the retracted position in the second feeder 20 (Act A109). At the retracted position, a portion of the leading edge of the single-sided thermal paper B may by pressed by the second roller 21*a* and the second roller 21*b*, which reduces stress that may be applied to the leading edge of the single-sided thermal paper B.

If the leading edges of the thermal papers A and B is left to be pressed by the rollers and thermal heads at the print waiting positions for a long time period, the pressure of the platen rollers 32 and 42 may deform the leading edges of the thermal papers A and B. When a subsequent printing is initiated to convey either of the thermal papers A and B, the leading edge of the conveyed thermal paper may be jammed on the conveying path 5.

On the other hand, according to the present embodiment, if printing is not performed for no less than a predetermined time period t1, the leading edges of the thermal papers A and B are moved to the positions upstream from the print waiting position where no stress is applied to the papers. Therefore, the deformation of the leading edges of thermal papers A and B may be prevented. Further, when printing, the thermal papers A and B may be safely conveyed without being jammed.

Figure 12:
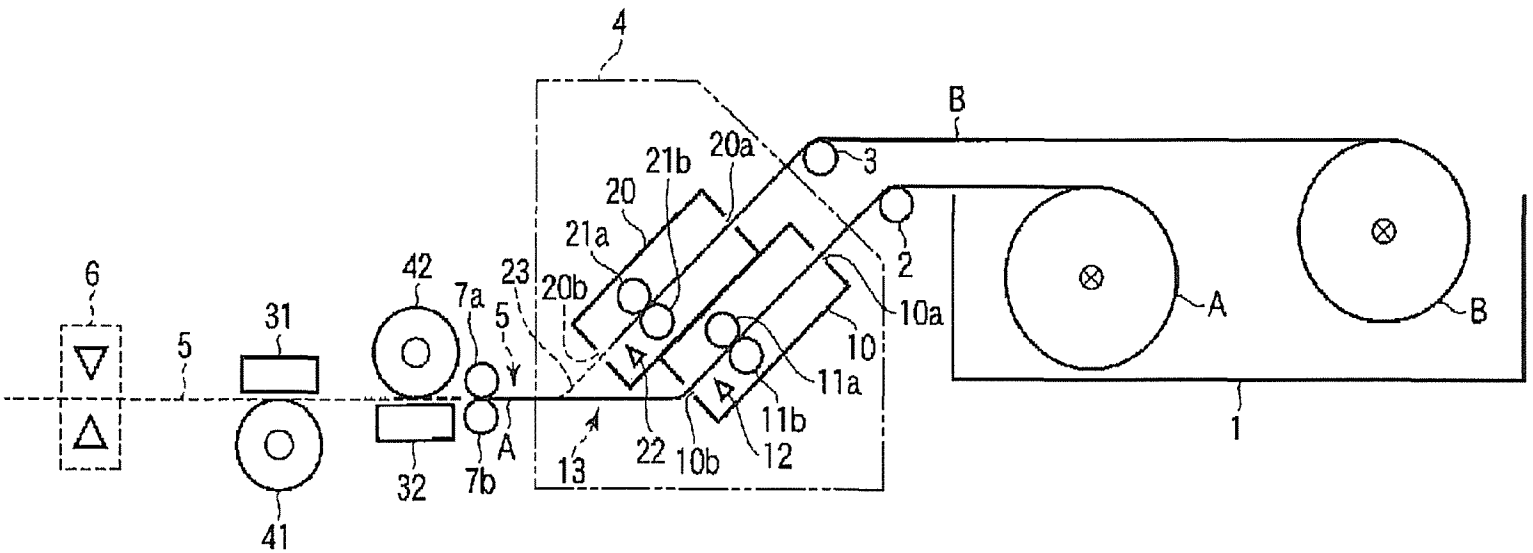
FIG. 12 shows thermal paper in an alternative retracted position.

The retracted positions where no stress is applied to the leading edges of the thermal papers A and B are not limited to the positions within the feeders 10 and 20, but may be in any position as long as they are upstream from the thermal heads 31 and 32 and the platen rollers 41 and 42, respectively. For example, in an embodiment as shown in FIG. 12, the paper feed rollers 7*a* and 7*b* may be provided upstream from the second thermal head 32 and the second platen roller 42 along the conveying path 5. In this embodiment, either the double-sided thermal paper A or the single-sided thermal paper B 5 is fed back along the conveying path 5 so that the leading edge of the double-sided thermal paper A or single-sided thermal paper B is moved to reach a position at the beginning of the paper feed rollers 7*a* and 7*b*. In this retracted position, a portion of the leading edge of the thermal papers may be pressed by the paper feed roller 7*a* and the paper feed roller 7*b*.

As used in this application, entities for executing the actions can refer to a computer-related entity, either hardware, a combination of hardware and software, software, or software in execution. For example, an entity for executing an action can be, but is not limited to being, a process running on a processor, a processor, an object, an executable, a thread of execution, a program, and a computer. By way of illustration, both an application running on an apparatus and the apparatus can be an entity. One or more entities can reside within a process and/or thread of execution and an entity can be localized on one apparatus and/or distributed between two or more apparatuses.

The program for realizing the functions can be recorded in the apparatus, can be downloaded through a network to the apparatus and can be installed in the apparatus from a computer readable storage medium storing the program therein. A form of the computer readable storage medium can be any form as long as the computer readable storage medium can store programs and is readable by the apparatus such as a disk type ROM and a Solid-state computer storage media. The functions obtained by installation or download in advance in this way can be realized in cooperation with an OS(Operating System) or the like in the apparatus.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A printer comprising:

a thermal head configured to print information on thermal paper;

a platen roller configured to press the thermal paper against the thermal head;

a paper feed unit configured to convey the thermal paper; and a control unit configured to control the paper feed unit to convey a leading edge of the thermal paper to a print waiting position between the thermal head and the platen roller and configured to control the paper feed unit to move the leading edge of the thermal paper from the print waiting position to a retracted position upstream the print waiting position, wherein the retracted position is a position upstream the print waiting position where less stress is applied to the thermal paper than at the print waiting position, and wherein the leading edge of the thermal paper is moved from the print waiting position to the retracted position if printing is not performed for a predetermined time period.

2. The printer of claim 1, wherein the thermal head comprises a first thermal head configured to print information on one side of the thermal paper, and a second thermal head configured to print information on the other side of the thermal paper.

3. The printer of claim 2, wherein the paper feed unit comprises a first feeder configured to convey the thermal paper by a first roller and a second feeder configured to convey additional thermal paper by a second roller.

4. The printer of claim 3, wherein the control unit controls the first feeder to move the leading edge of the thermal paper to a position at the beginning of the first roller and controls the second feeder to move the leading edge of the additional thermal paper to a position at the beginning of the second roller.

5. A printer comprising:

a thermal head configured to print information on thermal paper;

a platen roller configured to press the thermal paper against the thermal head;

a paper feed unit configured to move a leading edge of the thermal paper; and a paper sensor configured to detect the leading edge of the thermal paper to determine whether the thermal paper is located at a print waiting position between the thermal head and the platen roller for a predetermined time period.

6. The printer of claim 5, wherein, if the thermal paper remains at the print waiting position without being printed for a predetermined time period, the paper feed unit moves the leading edge of the thermal paper from the print waiting position to a retracted position upstream from the print waiting position.

7. The printer of claim 6, wherein the thermal head comprises a first thermal head configured to print information on one side of the thermal paper, and a second thermal head configured to print information on the other side of the thermal paper.

8. The printer of claim 7, wherein the paper feed unit comprises a first feeder configured to convey the thermal paper by a first roller and a second feeder configured to convey additional thermal paper by a second roller.

9. The printer of claim 8, further comprising: a control unit configured to control the first feeder to move the leading edge of the thermal paper to a position at the beginning of the first roller and control the second feeder to move the leading edge of the additional thermal paper to a position at the beginning of the second roller.

10. A method for controlling a printer including a thermal head for printing information on thermal paper, a platen roller for pressing the thermal paper against the thermal head and a paper feed unit configured to convey the thermal paper, the method comprising:

conveying a leading edge of the thermal paper to a print waiting position between the thermal head and the platen roller; and moving the leading edge of the thermal paper from the print waiting position to a retracted position upstream the print waiting position, wherein there is less stress on the thermal paper in the retracted position than at the print waiting position, and wherein the leading edge of the thermal paper is moved from the print waiting position to the retracted position if printing is not performed for a predetermined time period.

11. The method of claim 10, wherein the thermal head comprises a first thermal head configured to print information on one side of the thermal paper, and a second thermal head configured to print information on the other side of the thermal paper.

12. The method of claim 11, wherein the paper feed unit comprises a first feeder configured to convey the thermal paper by a first roller and a second feeder configured to convey additional thermal paper by a second roller.

13. The method of claim 12, wherein the leading edge of the thermal paper is moved to a position at the beginning of the first roller.

14. The method of claim 12, wherein the leading edge of the additional thermal paper is moved to a position at the beginning of the second roller.

15. The method of claim 10, wherein the printer further comprises a paper sensor configured to detect the leading edge of the thermal paper to determine whether the thermal paper is located at a print waiting position between the thermal head and the platen roller for a predetermined time period.

16. The method of claim 15, wherein the leading edge of the thermal paper is moved from the print waiting position to the retracted position, if the thermal paper remains at the print waiting position without being printed for a predetermined time period.

* * * * *